US005401923A

United States Patent [19]

Kato et al.

[11] Patent Number: 5,401,923

[45] Date of Patent: Mar. 28, 1995

[54] RESISTOR-PROVIDED UHV BREAKER

[75] Inventors: Norimitsu Kato; Hiroshi Sato, both of Yokohama; Shigeki Nishizumi, Tokyo; Hiroaki Toda; Hisatoshi Ikeda, both of Yokohama, all of Japan

[73] Assignee: Kabushiki Kaisha Toshiba, Kawasaki, Japan

[21] Appl. No.: 92,496

[22] Filed: Jul. 16, 1993

[30] Foreign Application Priority Data

Jul. 17, 1992 [JP] Japan ..... 4-191131
Jul. 28, 1992 [JP] Japan ..... 4-201587

[51] Int. Cl.[6] ..... H01H 33/16

[52] U.S. Cl. ..... 200/144 AP; 200/148 R; 338/215

[58] Field of Search ..... 200/144 R, 144 B, 144 AP, 200/148 R, 148 D, 150 J, 150 F; 338/215

[56] References Cited

U.S. PATENT DOCUMENTS 4,009,458 2/1977 Kishi et al. ..... 200/148 A
4,263,490 4/1981 Van ..... 200/144 AP
5,245,145 9/1993 Freeman et al. ..... 200/144 AP

FOREIGN PATENT DOCUMENTS 58-43748 3/1983 Japan .
3-34168 5/1991 Japan .

*Primary Examiner*—A. D. Pellinen
*Assistant Examiner*—Michael A. Friedhofer
*Attorney, Agent, or Firm*—Oblon, Spivak, McClelland, Maier & Neustadt

[57] ABSTRACT

A resistor-provided UHV breaker includes a tank, a main contact unit, a resistor unit, a resistor contact unit, support members, and a displacement absorbing system. The support members are arranged between the main contact and the resistor unit to support the resistor unit relative to the main contact unit. The displacement absorbing system is arranged at both ends of the resistor unit to absorb the relative displacement of the resistor unit in its axial direction.

13 Claims, 5 Drawing Sheets

RESISTOR-PROVIDED UHV BREAKER

BACKGROUND OF THE INVENTION

1. Field of the Invention

The present invention relates to a UHV breaker used in a UHV electric plant such as the substation on a million-volt power supply system line and, more particularly, a resistor-provided UHV breaker wherein resistor contacts for allowing making and breaking to be achieved through resistors are connected parallel to main contacts for allowing making and breaking to be achieved through no resistor.

2. Description of the Related Art

The resistor-provided breaker has been well-known as being suitable for use in a substation on a 500,000 volt power supply system line. In the case of this type of breaker, the making of a resistor is made about 10 ms before the making of a main contact to suppress overvoltage. When the priority making of the resistor is made in this manner, energy consumed by the resistor is about several Mjoules. The resistor is not so large in volume, length, and weight, as compared with those of the main contact. This small-sized and light-weight resistor, therefore, can be arranged parallel to the main contact and both of its ends can be fixed to the main contact by fixing members such as bolts. When it is fixed in this manner, it can have a high mechanical strength.

Recently, voltage supplied through the power transmission system line is made higher and higher and a power supply system line through which a ultra high voltage such as 1 million volts is supplied is now being planned. The UHV breaker intended to be used on this UHV power supply system line sometimes employs a main contact unit comprising two main contacts. In order to make the breaking easy, a resistor is sometimes inserted parallel to the main contact at making and even breaking times. The rise of recovery voltage caused in the main contact after the breaking is thus reduced. Further, the resistor is sometimes inserted parallel to the main contact to suppress overvoltage caused after the breaking of earthed current, for example. This resistor needs a resistor contact because it must be shut off from the main circuit 30–40 ms after the breaking is finished. As seen in the case of the 500,000 volt breaker, the resistor contact is closed at the making time. Overvoltage is thus suppressed by the resistor before the making of the main contact.

Energy which must be absorbed by the resistor of the resistor-provided UHV breaker becomes 20–30 times larger, as compared with energy absorbed by the resistor of the 500,000 volt breaker. The resistor which must be used by the resistor-provided UHV breaker to absorb this large energy becomes so large in volume, length, and weight, as compared with those of the resistor used by the 500,000 volt breaker. Particularly to obtain a certain voltage-resistant capacity, the resistor of this type must be made by piling a plurality of disk-like resistant elements one upon another. This makes the resistor quite longer than the conventional ones. The resistor is thus made larger in volume and heavier in weight. When it becomes quite larger, longer and heavier, it cannot have a high mechanical strength even if its both ends are fixed by a fixing member as seen in the conventional cases.

It is supposed that the resistor-provided UHV breaker becomes larger in size as compared with the 500,000 volt breaker. As the size increases with the UHV breaker, it is also supposed that the dimensional displacement of the UHV breaker becomes larger as the temperature rises. When the dimension of the resistor is changed, in this case, in the axial direction of the resistor by thermal expansion caused at the time of temperature rise, large stress is sometimes added to the resistor and support insulators by which the resistor is supported. This causes the resistor to be broken and the support insulators to be damaged.

SUMMARY OF THE INVENTION

The object of the present invention is therefore to provide a resistor-provided UHV breaker capable of preventing the mechanical strength of a resistor from being lowered and the resistor and other components from being damaged.

This object of the present invention can be achieved by a resistor-provided UHV breaker comprising a tank; a main contact unit arranged in the tank in the axial direction thereof; a resistor unit arranged in the tank in the axial direction thereof; a resistor contact unit arranged in the tank to cooperate with the resistor unit to form a parallel circuit; and support members arranged between the main contact unit and the resistor unit to support the resistor unit relative to the main contact unit.

The object of the present invention can also be achieved by a resistor-provided UHV breaker comprising a tank; at least one main contact arranged in the tank in the axial direction thereof; at least one resistor in arranged the tank in the axial direction thereof and including plural resistant elements and a connecting system supported by the main contact to connect the plural resistant elements each other; and at least one resistor contact arranged in the tank to cooperate with the resistor unit to form a resistant parallel circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
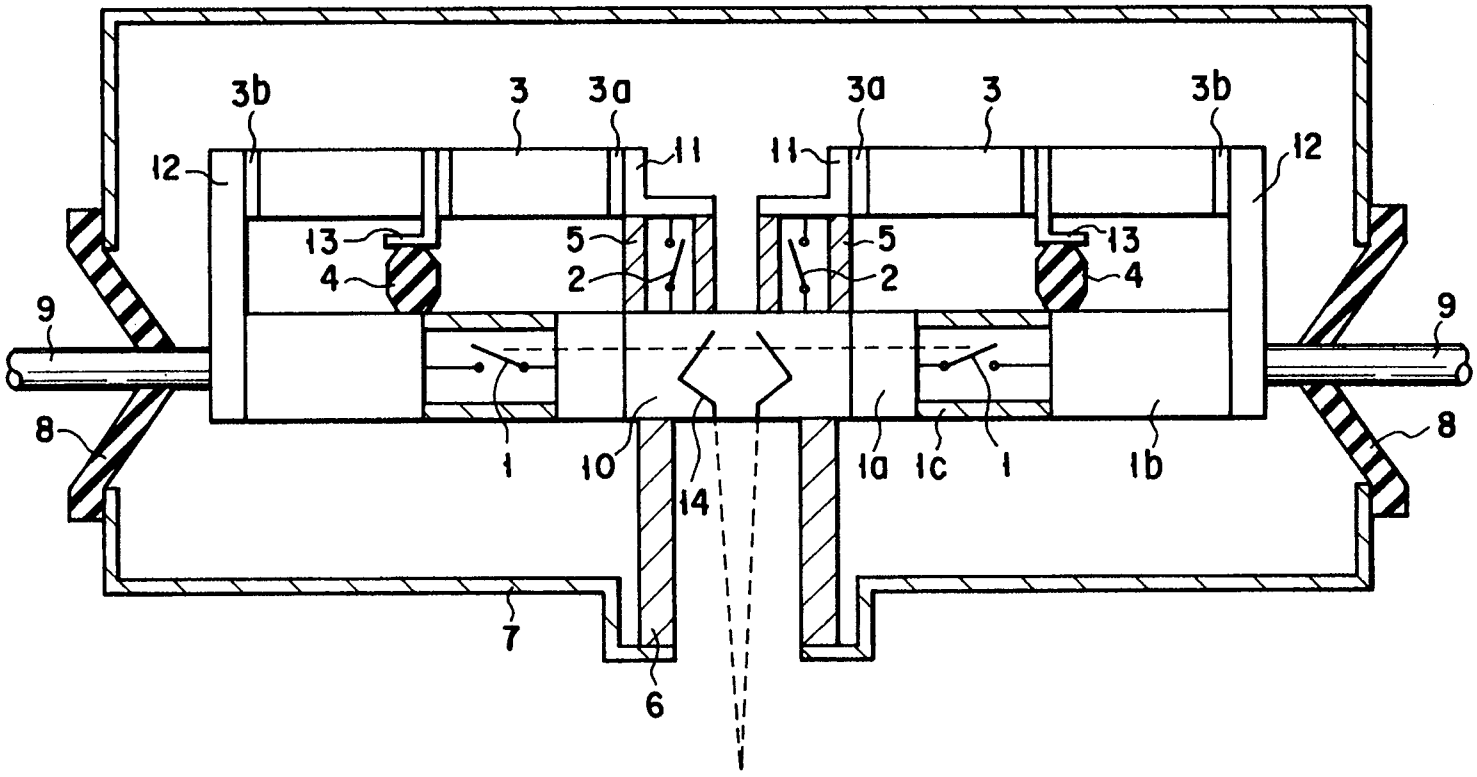
FIG. 1 shows the resistor-provided UHV breaker according to a first embodiment of the present invention.

The resistor-provided UHV breaker according to a first embodiment of the present invention will be described in detail with reference to FIG. 1. This resistor-provided UHV breaker includes two main contacts 1, two resistor contacts 2 and two resistors 3 arranged parallel to the main contacts 1. It also includes center support insulators 4 each supporting the center of each resistor 3 when viewed in the axial direction of the resistor 3, end support insulator sleeves 5 each supporting one end of each resistor 3 when viewed in the axial direction of the resistor 3, and a main insulator sleeve 6 for supporting the contacts 1.

These components are housed in an insulating-gas-filled and earthed gas tank (or closed container) 7. The gas tank 7 is closed by insulating spacers 8. Connecting conductors 9 extend outside the gas tank 7, passing through the insulating spacers 8. A center piece 10 is arranged between two main contacts 1 to connect them each other. Resistor support metal members 11–13 serve to support both ends and the center of each resistor 3 when viewed in the axial direction of the resistor 3. The main insulator sleeve 6 is arranged in the gas tank 7 in a direction perpendicular to the axial direction of the tank 7. The center piece 10 is fixed onto the main insulator sleeve 6. Two main contacts 1 are arranged on both sides of the center piece 10 on a line coaxial to the axis of the tank 7. They are mechanically fixed and electrically connected to the center piece 10. In short, they are electrically and mechanically connected to each other in series through the center piece 10. Each of them includes a movable main contact section 1*a*, a fixed main contact section 1*b* and a support insulator 1*c* for mechanically connecting these sections to each other. The movable main contact section 1*a* is electrically and mechanically connected to the center piece 10. The center support insulator 4 is attached onto each fixed main contact section 1*b*. The end support insulator sleeves 5 are attached onto the center piece 10. The resistor contact 2 is coaxially arranged in the hollow space of each end support insulator sleeve 5.

The two resistors 3 are arranged above the two main contacts 1 and parallel to them. The resistor support metal member 13 is provided in the center of each resistor 3. It is insulation-supported by each fixed main contact section 1*c* through the center support insulator 4. A resistor connecting section 3*a* is fixed to each resistor support metal member 11 by a fixing member such as the bolt. The resistor support metal member 11 is supported by each end support insulator sleeve 5. The resistor connecting section 3*a* is electrically and mechanically connected to each resistor support metal member 11. It is also connected in series to each resistor contact 2 through the resistor support metal member 11. It is also electrically connected to each movable main contact section 1*a* through the center piece 10.

Another resistor connecting section 3*b* is fixed to each resistor support metal member 12 by a fixing member such as a bolt. The resistor support metal member 12 is attached to an end of each fixed main contact section 1*b*. The resistor connecting section 3*b* is electrically and mechanically connected to each fixed main contact section 1*b* through the resistor support metal member 12. The connecting conductor 9 extending outside the tank 7 is connected to each resistor support metal member 12. The conductor 9 is supported by each insulating spacer 8.

When the first resistor-provided UHV breaker has the above-described arrangement, the following merits can be attained. Only both ends of each resistor 3 were fixed by fixing members such as bolts in the conventional resistor support system. In the case of this first embodiment of the present invention, however, it is needless to say that both ends of each resistor are fixed as seen in the conventional case. In addition, even the center portion of each resistor 3 is supported by the center support insulator 4 attached to the fixed main contact section 1*b*. This enables each of the long and heavy UHV resistors 3 to be supported with a higher mechanical strength. Further, no voltage is added to each center support insulator 4 when both of the main and resistor contacts 1 and 2 are opened. This prevents each of the center support insulators 4 from being deteriorated.

It is the center support insulator 4 and the resistor support metal member 13 that are newly added to support each of the resistors 3. And these center support insulator 4 and the resistor support metal member 13 are arranged in a space between the main contact 1 and the resistor 3. As apparent from FIG. 1, these components are extremely small in size and extremely simple in structure. In addition, no space is needed for each of the resistor contacts 2 because each of them is arranged in the end support insulator sleeve 5. This enables the entire breaker to be made smaller in size.

Figure 2:
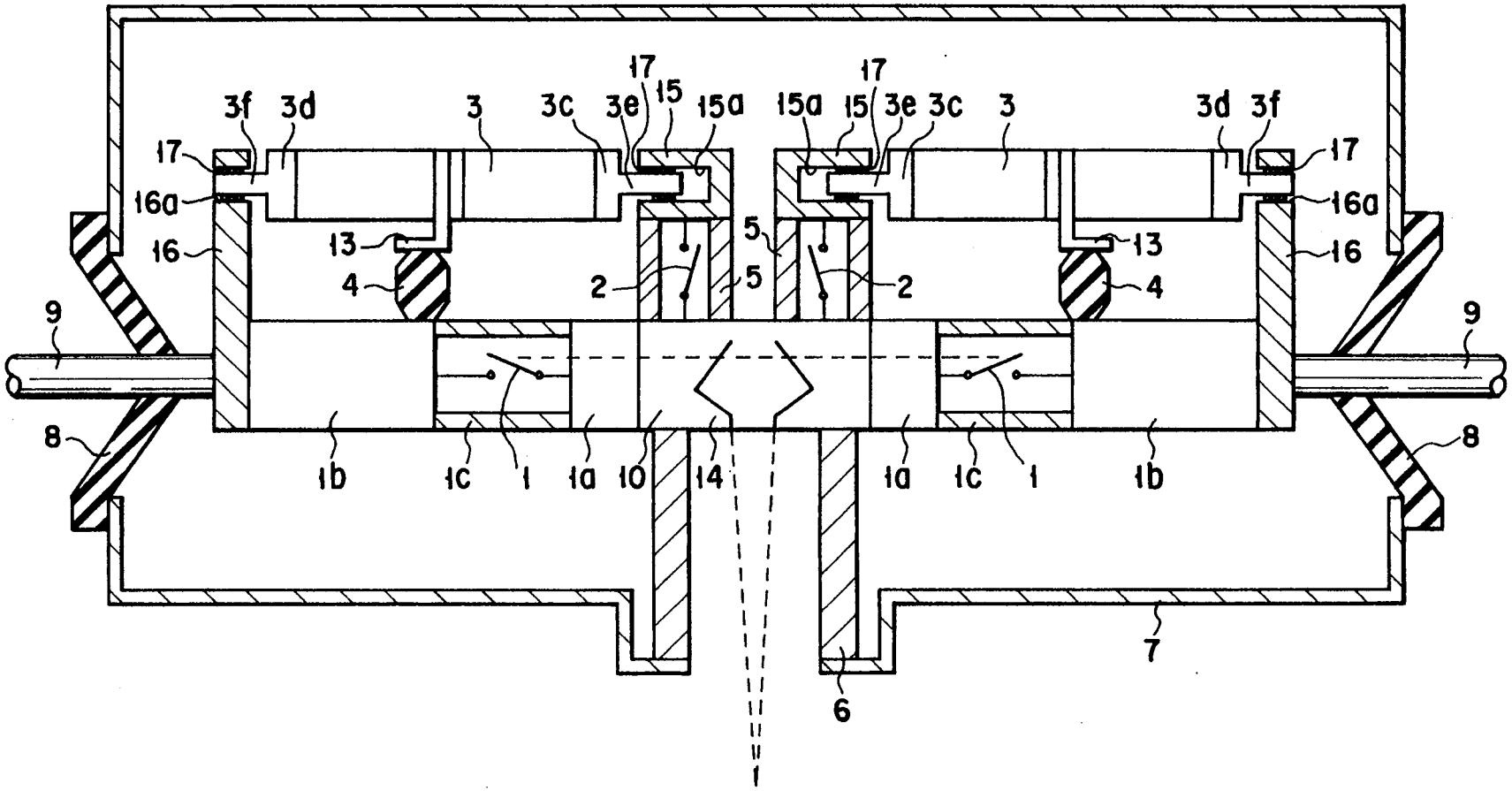
FIG. 2 shows the resistor-provided UHV breaker according to a second embodiment of the present invention.
Figure 3:
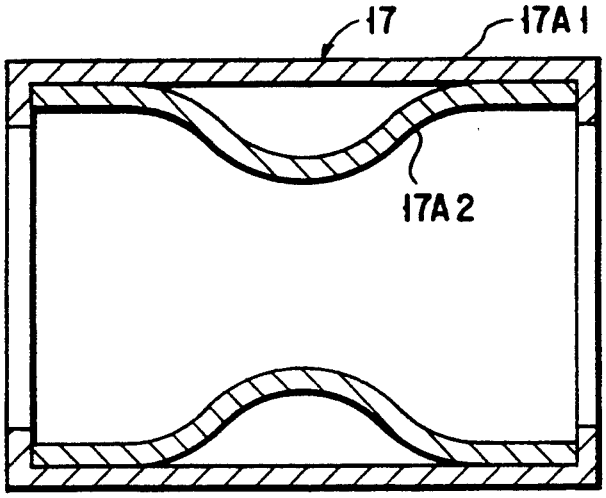
FIG. 3 shows a slide contact element.
Figure 4:
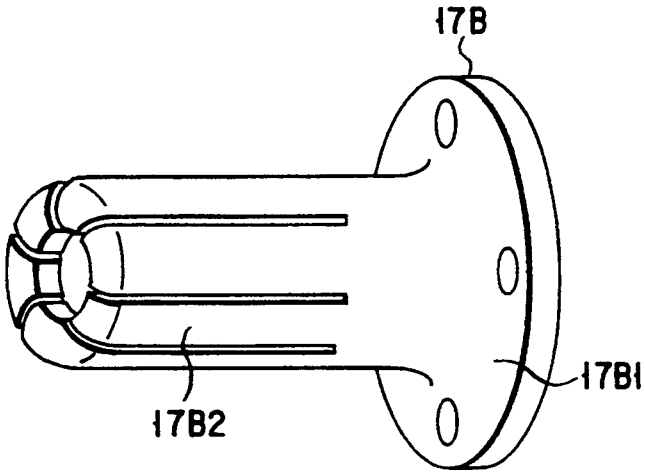
FIG. 4 shows another slide contact element.
Figure 5:
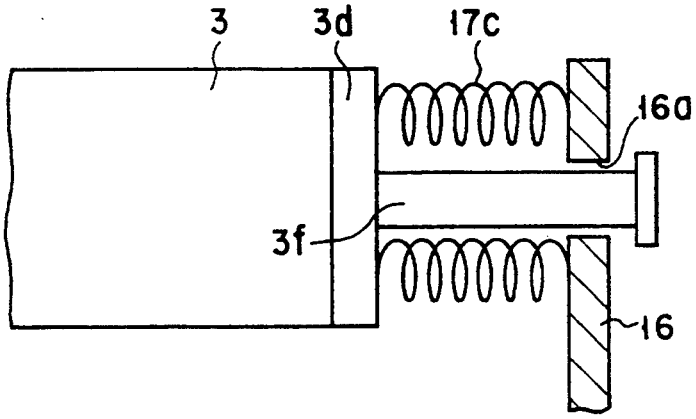
FIG. 5 shows a displacement absorbing system.

The resistor-provided UHV breaker according to a second embodiment of the present invention will be described with reference to FIG. 2. This second breaker is similar in structure to that of the first embodiment but differs in that it has displacement absorbing systems. Each of the displacement absorbing systems comprises resistor connecting sections 3*c* and 3*d* fixed to both ends of each resistor 3, resistor support metal members 15, 16 and slide contact elements 17. More specifically, the resistor support metal member 15 is arranged on each resistor contact 2. The resistor support metal member 16 is attached to an end of each fixed main contact section 1*b*. A hole 15*a* is formed in each resistor support metal member 15. The depth direction of each hole 15*a* is made parallel to the axial direction of each main contact 1. A hole 16*a* is formed in each resistor support metal member 16. The depth direction of each hole 16*a* is also made parallel to the axial direction of each main contact 1. A projection 3*e* is projected from each resistor connecting section 3*c* to enter into the hole 15*a*. Another projection 3*f* is also projected from each resistor connecting section 3*d* to enter into the hole 16*a*. Slide contact elements 17 are interposed between the hole 15*a* of each resistor support metal member 15 and the projection 3*e* of each resistor connecting section 3*c* and between the hole 16*a* of each resistor support metal member 16 and the projection 3*f* of each resistor connecting section 3*d*. These slide contact elements 17 serve to keep each resistor 3 electrically contacted with the resistor support metal members 15, 16 even if the resistor 3 is made extended and contracted. Those which are shown in FIGS. 3 and 4 can be used as the slide contact element 7. A slide contact element 17A of the plate spring type shown in FIG. 3 comprises a cylinder 17A1 and a plate spring shaped contact 17A2 arranged in the cylinder 17A1. Another slide contact element 17B of the splitted strip type comprises a cylinder 17B1 and plural contacts 17B2 attached to an end face of the flange 17B1. The displacement absorbing system comprises interposing a conductive coil spring 17C between each resistor connecting section **3*d* and each resistor support metal member 16, as shown in FIG. 5**.

According to this second breaker having the above-described arrangement, it can be absorbed by the displacement absorbing system even if each resistor 3 is expanded in the axial direction thereof when temperature rises. More specifically, the resistor connecting sections **3*c* and 3*d* of each resistor 3 can be slid in the axial direction thereof and in relation to the resistor support metal members 15 and 16 when the resistor 3 is expanded in the axial direction thereof at the time of temperature rise. This makes it easier to absorb the expansion of each resistor 3. Therefore, unnecessary stress is not added to the resistor 3, and the center support insulator 4 and the end support insulator sleeve 5 by which the resistor 3 is supported. The second breaker can be thus expected to have a higher mechanical reliability. When each resistor 3 is to be assembled into the breaker by bolts, its assembling must be made while adjusting the dimension adjusting spacer. When it is slidably attached to the breaker as seen in the case of the second breaker, however, dimensional error can be absorbed to a greater extent. This makes it much easier to make dimensional adjustment at the time of assembly. The assembling workability of this second breaker can be thus enhanced. To add more, each resistor 3 is fixed at that point at which it is supported by the center support insulator 4. The dimensional displacement of each resistor 3 which is caused by thermal expansion is therefore distributed to both ends of the resistor 3. The extent to which each connecting section of the resistor 3 must be slid can be enough even if it is half the expansion of the resistance 3**. The slide structure can be thus made smaller in size and its design can also be made easier and simpler.

The present invention is not limited to the above-described embodiments. The center of each resistor may be supported by plural support insulators instead of single support insulator, and they may be appropriately shaped like rods and cylinders. Further, elastic members such as springs may be used, instead of the slide structure, to form the displacement absorbing system. Still further, a structure of each main contact may be freely selected.

Figure 6:
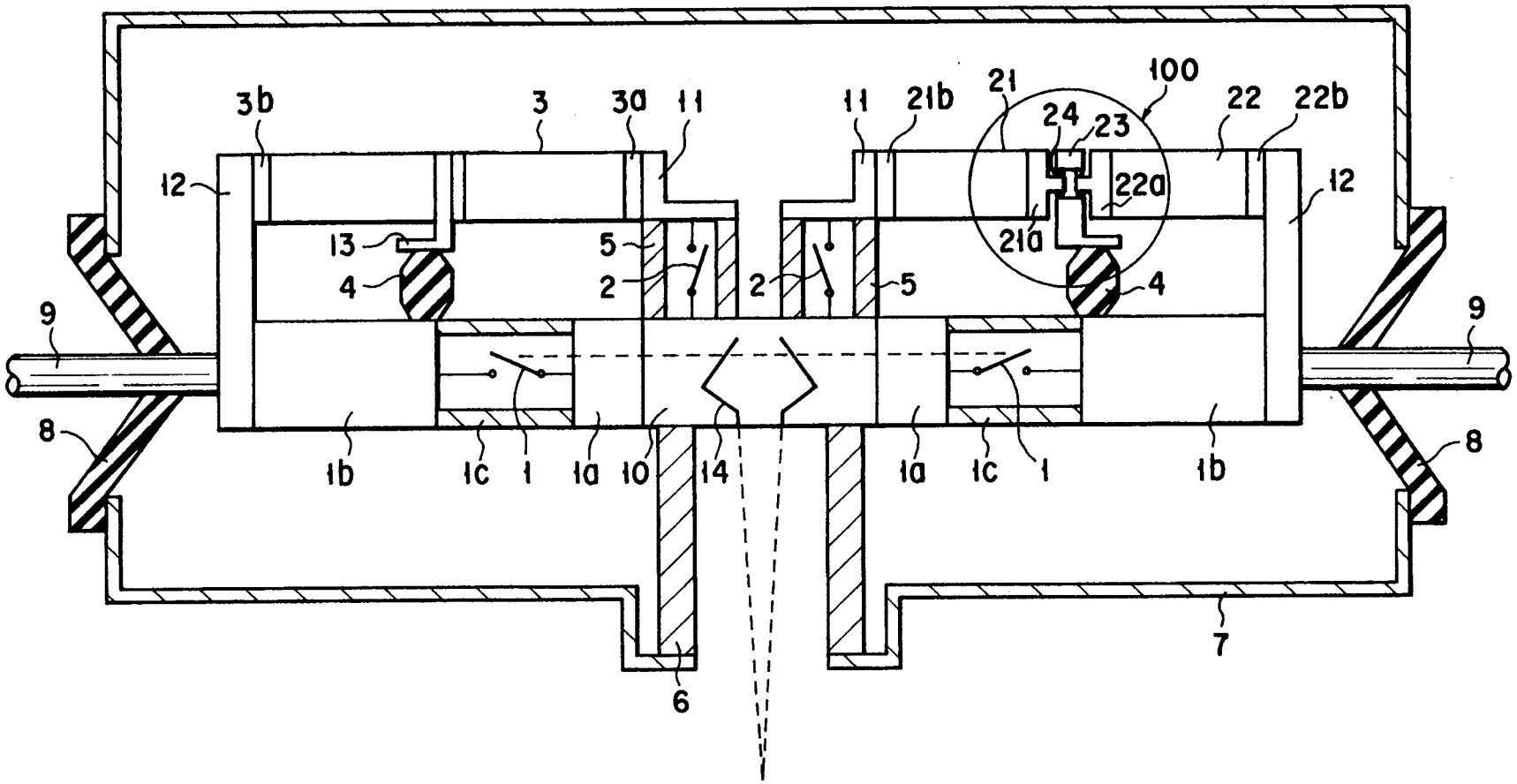
FIG. 6 shows the resistor-provided UHV breaker according to a third embodiment of the present invention.

The resistor-provided UHV breaker according to a third embodiment of the present invention will be described with reference to FIGS. 6 and 7. The third resistor-provided UHV breaker is fundamentally similar to that of the first embodiment but differs in that portion which is enclosed by circle 100 in FIG. 6.

The resistor 3 comprises two resistant elements 21 and 22 and a connecting member 23 for connecting the resistant elements 21 and 22 in series. The connecting member 23 serves as a system for connecting the resistant elements 21 and 22 to each other and as a system for supporting the resistor 3 relative to the main contact 1. It can be therefore supposed that the connecting member 23 serves as the supporting system to which the connecting system is added and reversely, as the connecting system to which the supporting system is added. Further, the connecting member 23 also serves as the system for absorbing the displacement of the resistor 3 in the axial direction of the resistor 3.

Figure 7:
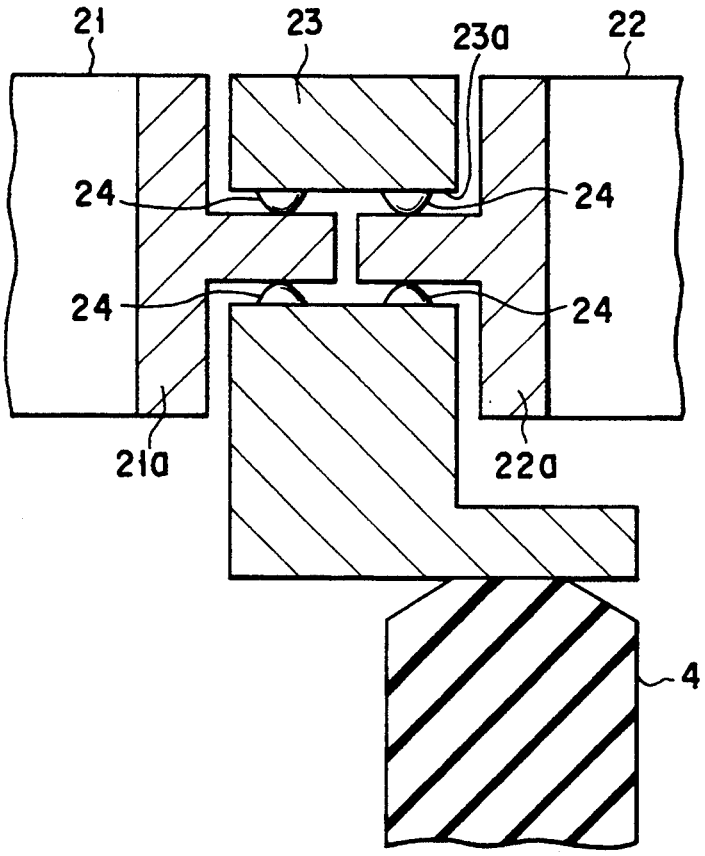
FIG. 7 shows that portion of the breaker, which is enclosed by a circle 100 in FIG. 6, enlarged.

As shown in detail in FIG. 7, the connecting member 23 supports opposed projections **21*a* and 22*a* of the resistant elements 21 and 22, and it is also fixed to the center support insulator 4. Slide contact elements 24 same as those shown in FIG. 3 and 4 can be arranged in a hole 23*a* of the connecting member 23. When the slide contact elements 24 are arranged in the hole 23*a* in this manner, the opposed projections 21*a* and 22*a* of the resistant elements 21 and 22 can be mechanically slid relative to the slide contact elements 24 in the axial direction of the resistor 3, and the opposed projections 21*a* and 22*a* can be electrically connected to the slide contact element 24. The slide contact elements 24 are also insulation-supported relative to the fixed main contact section 1*b* by the center support insulator 4**.

One of the resistant element 21 of the resistor 3 is fixed to the end support metal member 11 by bolts (not shown). The end support metal member 11 is supported by each end support insulator sleeve 5. One of the resistant element 21 of the resistor 3 is thus electrically and mechanically connected to the end support metal member 11. The end **21*b* of the resistant element 21 is connected in series to the resistor contact 2 via the end support metal member 11 and electrically to the movable main contact section 1*a* via the center piece 10 in this case. It is also supported by the center piece 10 and mechanically fixed to the movable main contact section 1*a* through the end support metal member and insulator sleeve 11 and 5**.

One end **22*b* of the other resistant element 22 of the resistor 3 is fixed to the end support metal member 12 by bolts. The end support metal member 12 is attached to one end of the fixed main contact section 1*b*. The other resistant element 22 is thus electrically and mechanically connected to the fixed main contact section 1*b*. The connecting conductor 9 extending outside the breaker is connected to the end support metal member 12 and it is supported by the insulator spacer 8**.

Even when the resistor 3 is expanded in the axial direction thereof at the time of temperature rise in the case of the above-described third embodiment, it can be easily absorbed because the opposed projections **21*a* and 22*a* of the resistant elements 21 and 22 are slid relative to the connecting member 23 in the axial direction of the breaker. Any unnecessary stress, therefore, is not added either to the resistor 3 or to the center and end support insulator and sleeve 4 and 5 by which the resistor 3** is supported, thereby enabling the breaker to have a higher mechanical reliability.

When each resistor 3 is to be assembled into the breaker only by bolts, its assembling must be made while adjusting the dimension adjusting spacer. When it is to be slidably incorporated into the breaker as seen in the above-described third case, however, dimensional error can be absorbed to a greater extent. This makes it extremely easier to make dimensional adjustment at the time of resistor assembly, thereby enabling the assembling workability of the breaker to be enhanced. To add more, the connecting member 23 located at the center of the resistor 3 is the support member which supports slidably the opposed projections **21*a* and 22*a*. The dimensional displacement of the resistor 3 which is caused by thermal expansion can be thus distributed to the resistant elements 21 and 22. The extent to which each of the opposed projections 21*a* and 22*a* must be slid can be enough if it is only half the expansion of the whole resistor 3**. The slide structure of each resistor can be thus made smaller in size and its design can also be made easier and simpler.

Although each resistor 3 was supported by fixing only both ends of it by bolts in the conventional case, its center portion (or connecting member 23) is further supported, in the above-described third case, by the center support insulator 4 which is attached to the fixed main contact section 1*b*. Each UHV resistor, although long and heavy, can be thus supported with a fully higher mechanical strength. Both ends 21*b* and 22*b* of the resistor 3 are firmly fixed to the end support metal members 11 and 12 by bolts in this case. A relatively smaller load is therefore added to the center support insulator 4 by which the connecting member 23 of the resistor 3 is supported, as compared with the load added to both ends 21*b* and 22*b* of the resistor 3. This adds a higher reliability to the breaker. Further, the resistor 3 is supported by the center support insulator 4 which is attached to the fixed main contact section 1*b*. When both of the main 1 and the resistor contact 2 are opened, therefore, no voltage is added to the center support insulator 4. This prevents the center support insulator 4 from being deteriorated.

The resistor support structure in this third breaker is different from those in the conventional cases only in that the resistor 3 is divided into resistant elements 21 and 22 and these elements are connected by the connecting member 23 and that the center support insulator 4 is arranged in a space between the main contact 1 and the resistor 3 and the connecting member 23 is supported by the center support insulator 4. As apparent from FIG. 6, this resistor support structure is quite simple and small in size.

The present invention is not limited to the above-described embodiments. The center of each resistor may be supported by plural center support insulators instead of a single support insulator, and they may be freely shaped like rods or cylinders. Further, the connection of resistor units of the resistor to each other may be freely selected. Furthermore, the arrangement of the main and resistor contacts in the breaker may be freely selected.

According to the present invention as described above, each resistor can be supported with a higher mechanical strength. In addition, each resistor and its support insulator can be prevented from being damaged even if its dimensional displacement is caused in its axial direction. Further, the .resistor support structure can be made simpler and smaller in size with a higher reliability.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A resistor-provided UHV breaker comprising:

a tank;

a main contact unit arranged within said tank along a first direction which is parallel to an axial direction of said tank;

a resistor unit arranged within said tank along said first direction;

a resistor contact unit arranged within said tank along a second direction which is perpendicular to said first direction so as to cooperate with said resistor unit and thereby form a parallel circuit; and a plurality of support members arranged between said main contact unit and said resistor unit for supporting center portions of said resistor unit along said axial direction of said tank, wherein said support members are located at a center of said resistor unit when viewed along said first direction.

2. The resistor-provided UHV breaker according to claim 1, further comprising a displacement absorbing system for absorbing relative displacement of said resistor unit along said first direction.

3. The resistor-provided UHV breaker according to claim 2, wherein said displacement absorbing system is arranged at least at one end of said resistor unit.

4. The resistor-provided UHV breaker according to claim 2, wherein said displacement absorbing system is arranged at least at a center portion of said resistor unit when viewed from said second direction.

5. The resistor-provided UHV breaker according to claim 2, wherein said displacement absorbing system is attached to each of said plurality of support members.

6. The resistor-provided UHV breaker according to claim 2, wherein said displacement absorbing system comprises a sliding system having at least one slide contact element.

7. The resistor-provided UHV breaker according to claim 1, wherein said main contact unit includes a plurality of main contacts arranged along said first direction.

8. The resistor-provided UHV breaker according to claim 1, wherein said resistor unit includes a plurality of resistors arranged along said first direction.

9. The resistor-provided UHV breaker according to claim 1, wherein said resistor contact unit is arranged within said tank at the center thereof and along said second direction.

10. The resistor-provided UHV breaker according to claim 1, wherein said resistor contact unit includes a plurality of resistor contacts arranged along said second direction.

11. A resistor-provided UHV breaker comprising:

a tank;

at least one main contact arranged within said tank along a first direction;

a resistor unit arranged within said tank along said first direction;

at least one resistor unit arranged within said tank along said first direction and including a plurality of resistance elements and a connecting system supported by said at least one main contact for connecting each of said plurality of resistance elements to one another;

at least one resistor contact arranged within said tank at a center thereof and along a second direction which is perpendicular to said first direction so as to cooperate with said at least one resistor unit and thereby form a parallel resistance circuit; and a plurality of support members arranged between said main contact unit and said resistor unit for supporting center portions of said resistor unit along an axial direction of said tank, wherein said support members are located at a center of said resistor unit when viewed along said first direction.

12. The resistor-provided UHV breaker according to claim 11, wherein said connecting system includes a displacement absorbing system for absorbing relative displacement of said plurality of resistance elements along said first direction.

13. The resistor-provided UHV breaker according to claim 12, wherein said displacement absorbing system includes a slide member for sliding each of said plurality of resistance elements toward one another, and a plurality of slide contact elements attached to said slide member and electrically connected to said plurality of resistance elements.

* * * * *